United States Patent [19]

Mautner et al.

[11] Patent Number: 4,526,107

[45] Date of Patent: Jul. 2, 1985

[54] RAILWAY TRUCK FOR SELF-PROPELLED RAILWAY VEHICLES

[75] Inventors: Franz Mautner, Munich; Peter Schwarzler, Fürstenfeldbruck; Manfred Mittermaier, Munich, all of Fed. Rep. of Germany

[73] Assignee: Krauss-Maffei Aktiengesellschaft, Munich, Fed. Rep. of Germany

[21] Appl. No.: 403,704

[22] Filed: Jul. 30, 1982

[30] Foreign Application Priority Data

Aug. 1, 1981 [DE] Fed. Rep. of Germany ..... 3130603

[51] Int. Cl.[3] ..... B61B 9/38

[52] U.S. Cl. ..... 105/133; 105/182 E; 188/59

[58] Field of Search ..... 105/34 R, 133–138, 105/131, 182 R, 182 E; 188/59

[56] References Cited

U.S. PATENT DOCUMENTS

| | | | |
|---|---|---|---|
| 1,670,541 | 5/1928 | Jackson | 105/138 |
| 3,239,032 | 3/1966 | Freholm | 188/59 |
| 3,447,484 | 6/1969 | Stein | 105/136 |
| 3,570,408 | 3/1971 | Lich | 105/133 |
| 4,148,262 | 4/1979 | Eichinger | 105/135 X |
| 4,167,906 | 9/1979 | Steinmann et al. | 105/135 X |
| 4,170,945 | 10/1979 | Kayserling | 105/136 X |
| 4,231,296 | 11/1980 | Jackson | 105/136 |

FOREIGN PATENT DOCUMENTS

| | | |
|---|---|---|
| 7821954 | 10/1978 | Fed. Rep. of Germany . |
| 2822992 | 11/1979 | Fed. Rep. of Germany . |
| 3119332 | 12/1982 | Fed. Rep. of Germany . |
| 1263903 | 5/1961 | France . |

*Primary Examiner*—Randolph Reese

*Attorney, Agent, or Firm*—Karl F. Ross; Herbert Dubno

[57] ABSTRACT

A bogie for a self-propelled railway car comprises a brake for at least two wheel sets, the axle of one of which can be driven by an electric motor through a gear train. According to the invention, not only is the support frame mounted upon a pin depending from the vehicle chassis and a secondary spring suspension provided between this frame and the chassis, but the pin also carries at least part of the weight of the motor and drive train and/or the brake system. Both the drive train and the brake system are connected to the driven axle by a universal joint shaft arrangement and a primary suspension is provided between the axles and the frame.

7 Claims, 4 Drawing Figures

RAILWAY TRUCK FOR SELF-PROPELLED RAILWAY VEHICLES

CROSS REFERENCE TO RELATED APPLICATION

This application is related to the commonly assigned copending application Ser. No. 376,245 filed May 7, 1982.

FIELD OF THE INVENTION

This invention relates to a railroad car bogie and, more particularly, to a car or truck for driven or undriven wheels of a railroad carriage, e.g. a self-propelled railroad car, a railway vehicle towed by a locomotive or the locomotive itself.

More specifically, this invention relates to a bogie or undercarriage or railroad vehicle having at least two sets or pairs of wheels, a support frame, and means enabling the support frame to pivot about an upright axis relative to the vehicle chassis, i.e. a pivotal bogie, truck or carriage.

BACKGROUND OF THE INVENTION

As described in the aforementioned copending application (see also German patent document No. 3,119,332), the railroad bogie, undercarriage or truck can have to or more sets of wheels mounted in a support frame which can pivot about a vertical or upright axis relative to the chassis of the railroad vehicle to enable the latter to successfully negotiate curves or the like.

In driving carriages of this type, one or more drive motors, especially electric motors, are fixed to the undercarriage and connected by universal joint shafts to the driven axle to propel the wheels.

Such railway undercarriages are widely used and, for example, are incorporated in the E120 electric locomotives of the German Federal railway system. To minimize the mass which is not resiliently suspended, the drive unit of such trucks is generally pivotally mounted in the wheel-carrying frame utilizing pivots whose axes run perpendicular to the direction of the vehicle travel.

While this system has been largely effective, in recent years there has been an increasing interest in higher capacity rail systems, higher speed railroad trains and vehicles capable of carrying larger loads at these higher speeds.

As these demands have increased, the sensitivity to masses which were not resiliently suspended or adequately suspended relative to the vehicle bodies has increased. Special spring systems were proposed for the drive unit and the respective transmission, both of which are comparatively heavy.

Such special suspension arrangements were not only complicated and expensive but also required considerable maintenance and were prone to failure.

OBJECTS OF THE INVENTION

It is the principal object of the present invention to provide an improved railroad truck, especialy for self-propelled railway vehicles or locomotives, whereby the disadvantages of earlier systems are obviated.

Another object of this invention is to improve the resilient suspension of parts of the railroad vehicle truck and especially the drive motor and gear transmission therefor and/or a brake system for the latter without significantly increasing the cost.

Still another object of the invention is to provide an improved railroad truck or bogie with a more rational relationship of the drive and braking train to the pivotable undercarriage support.

SUMMARY OF THE INVENTION

These objects and others which will become more readily apparent hereinafter are attained, in accordance with the present invention, in a railroad truck system comprising a pivot pin depending from the chassis of the vehicle, a support ring pivotally mounted on this pin and provided with at least two sets of wheels for engaging respective tracks, each set of wheels having a wheel axle, a drive motor and gearing operatively connected to at least one of the wheel axles, e.g. via a universal-joint or Cardan-joint system, and means for pivotally mounting the latter drive train upon this pivot pin as well.

According to the invention, therefore, a linkage is provided for pivotally supporting the drive train including the motor and gearing, but also the brake system if one is provided, upon the pivot pin by which the frame itself is connected to the chassis so as to be angularly displaceable thereon.

Since the drive unit is directly connected pivotally with the pivot pin and the latter is connected directly to the vehicle chassis, the primary spring suspension, which is provided between the axle and the support frame, need not suspend the drive train or be dimensioned to take into consideration the mass of the drive train.

The drive train can in part be linked to the frame so that only the portion of the mass thereof which is not supported by the pivot pin need affect the secondary spring suspension which is provided between the chassis and the support frame.

According to a feature of the invention, the articulating means pivotally connecting the drive train to the pivot pin is secured to the drive train at a location proximal to the electric motor, namely, in the region of the heaviest portion of the drive train.

The linkage is thus disposed and arranged to be able to support this greatest portion of the mass of the drive train and preferably engages the pivot pin below the region at which the frame is swingably mounted thereon. Below the linkage, a thrust plate can be affixed to the pivot pin to support the linkage against vertical movement along the pin.

The vertical movements of the chassis relative to the support frame within the limits defined by the suspension springs are permitted in part by the hollow universal or Cardan shaft arrangement connecting the drive train to the driven wheel axle. This mobility is ensured in part by providing the Cardan shaft coupling so that it includes a first hollow shaft surrounding the driven axle and a second hollow shaft coaxially surrounding the first hollow shaft and the driven axle, one Cardan or universal joint being provided between the two hollow shafts, another Cardan or universal joint being provided between the opposite ends of the first shaft and the driven axle and the corresponding ends of the second shaft being connected to the gear train which is coupled with the motor.

The second hollow shaft which receives the driven pinion of the aforementioned train has been found to greatly simplify the coupling of the motor to the driven axle.

Means can also be provided, in accordance with the present invention, to allow transverse movement of the bogie frame relative to the direction of travel, this means including a parallelogramatic linkage and a damping member such as a shock absorber.

The stability of the suspension can be increased by providing the gear train in a housing, one end of which is connected by a flange coupling to the motor, and by also providing parallel to this housing at the other end of the drive motor, a support bracket which also is articulated to the support frame.

We have found that the second hollow shaft can also carry the brake disks and that the disk brake unit cooperating with these disks can be mounted upon the drive train with additional advantages with respect to the suspension.

These arrangements permit part of the mass of the braking system to be carried by the pivot pin and, indeed, the two hollow shaft arrangements can be utilized together with a brake system which is supported on the pivot pin even without a drive train of the type described.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
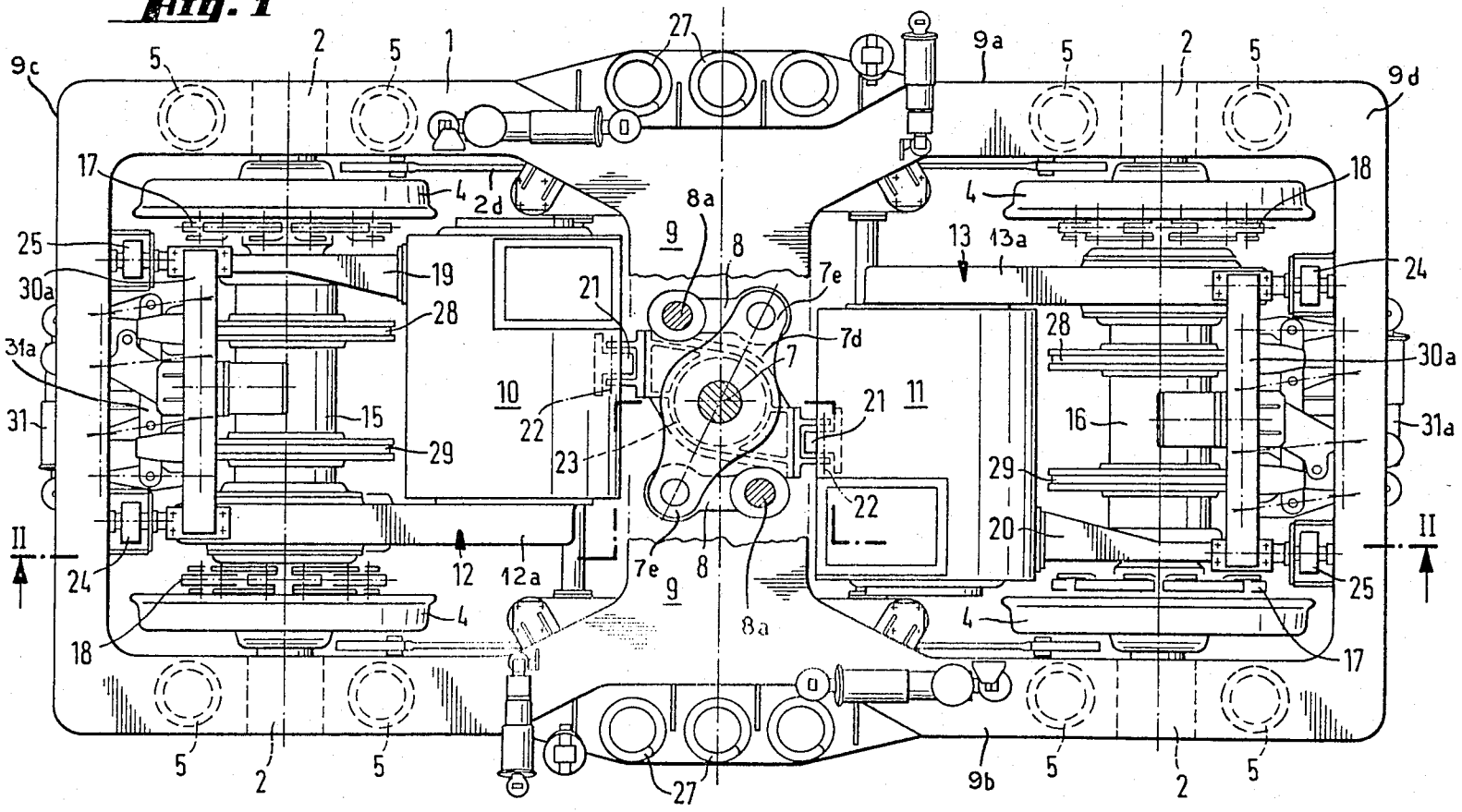
FIG. 1 is a plan view, taken in horizontal section through the pivot pin of a railroad car bogie according to the invention, parts of the resilient suspension being shown only diagrammatically.

In the drawing we have shown an angularly displaceable wheel-carrying frame 1 forming part of a railway truck or bogie and adapted to pivot or to be angularly displaced about an upright axis defined by a pivot pin 7 depending from the railway car chassis.

In the embodiment described, the wheels are driven by electric motors, i.e. the railway car is of the self-propelled type, e.g. of the kind used on subways, elevated lines, suburban rail lines and both intra-urban and inter-urban rail lines in which the electric power may be picked up, for example, from a third rail paralleling the track or by a pantograph from overhead lines.

The term "railwway car" or "railway vehicle" as used herein is also intended to refer to electric powered locomotives which may tow or push other cars which may be or may not be of the self-propelled type, the electric motors drawing electric power in the manner described and/or receiving this power from a diesel engine generator set.

As described in the corresponding application or German patent document No. 3,119,332, the frame can carry a pair of wheel axles, the wheel axles being coupled together, or to the frame to perform a predetermined relative movement as the wheel carriage passes along curved tracks where one-sided forces are provided axially against one or both of the wheel axes.

The wheel axles 3 are mounted in wheel bearings 2 (see FIG. 4) by means of which the wheel 4 can be elastically suspended from the carriage frame.

Figure 4:
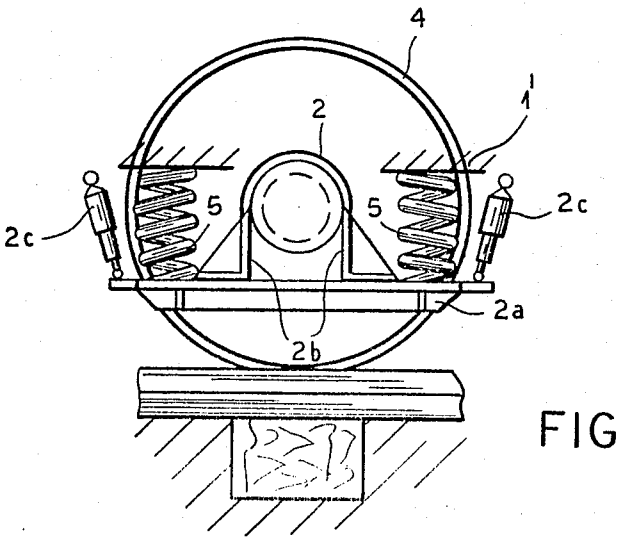
FIG. 4 is a diagrammatic side elevational view of a portion of the primary suspension.

In FIG. 4, a portion of this frame has been shown at 1' and the compression springs 5 bear thereagainst.

The springs 5 are also seated against a beam **2*a* to which the wheel bearing 2 is connected by brackets 2*b*. The beam 2*a* also is pivotally connected to dashpot dampers 2*c*** which form shock absorbers and sway limiters for this beam.

Figure 2:
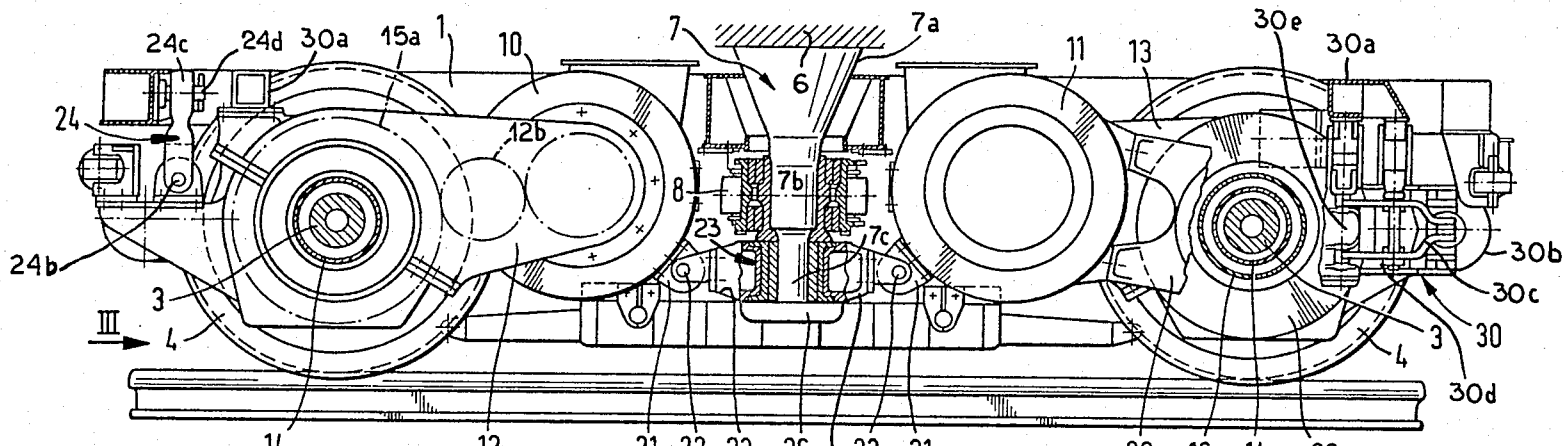
FIG. 2 is a section taken along lines II—II of FIG. 1.

The beam **2*a* may also be provided with a linkage diagrammatically represnted at 2*d* (FIG. 1) which can be equivalent to the links shown in FIG. 2**, for example, of the aforementioned copending application.

The vehicle chassis or body has been shown only diagrammatically at 6 and can be considered to be a conventional railway car chassis provided with at least two wheel trucks of the type shown in FIG. 1, e.g. one such truck being provided at each end. When the vehicle is of the self-propelled type, this car can include a cab for the operator which can contain controls enabling the operator to regulate the energization of an electric motor 10 driving the wheels.

The pin 7 upon which the frame 1 is pivotally mounted, can have a frustoconical downwardly converging upper portion **7*a*, a cylindrical central portion 7*b* and a small diameter lower portion 7*c*. In the embodiment shown, the frame 1 has a central beam 9, a pair of longitudinally extending beams 9*a* and 9*b*, and a pair of transverse end beams 9*c* and 9*d***.

All of these beams may be composed of steel angles, channels or other structural shapes. To journal the frame 1 upon the pin 7, a member **7*d* is mounted upon the cylindrical portion 7*b* and has oppositely extending lugs 7*e* to which links 8 are pivotally connected, the other ends of the links 8 being pivotally connected to pins 8*a* fixed to the frame 1. Consequently, the frame 1 can rotate about the pivot pin 7 and, in addition, can shift somewhat transversely with respect to this pin. The frame 1 also receives two electric motors 10, 11, respectively connected by gear transmissions 12, 13 with a first hollow shaft 14 and with a second hollow shaft 15 or 16**, respectively.

The housing **12*a* or 13*a* of the gear transmission is rigidly connected to the housing of the respective electric motors 10 or 11 by a flange connection and the output gear, e.g. the gear diagrammatically represented at 12*b* in FIG. 2, is drivingly connected to the second hollow shaft 15 or 16, e.g. meshing with the gear 15*a* affixed to this hollow shaft. The hollow shafts 15 and 16 are connected by Cardan or universal joints 17 with one end of the first hollow shaft 14 and the opposite end of the hollow shaft 14 is connected by another Cardan or universal joint 18 with one of the wheels 4 of the pair of wheels interconnected by the common axle. Such compound shafts 14–18** are known for similar purposes and are generally termed Cardan hollow shafts.

Each motor 10 or 11, together with the respective gear transmission 12 or 13, and a respective support bracket 19 or 20 forms a respective drive unit 10/12/19 or 11/13/20 in which, at its free end, the second hollow shaft 15 or 16 is journaled.

The drive units 10/12/19 and 11/13/20 are pivotally connected by respective lugs 21 and pivot pins 22 to a support ring 23 mounted upon the lower portion **7*c* of pin 7 and having a pair of arms 23*a*, 23*b* with bifurcated ends receiving the lugs 21**.

The gear transmissions 12, 13 and the support brackets 19, 20 are pivotally connected by support forks 24, 25 to the frame 1. The support forks 24, 25 have their bifurcated ends **24*a*, 25*a* connected by pivot pins 24*b***

Figure 3:
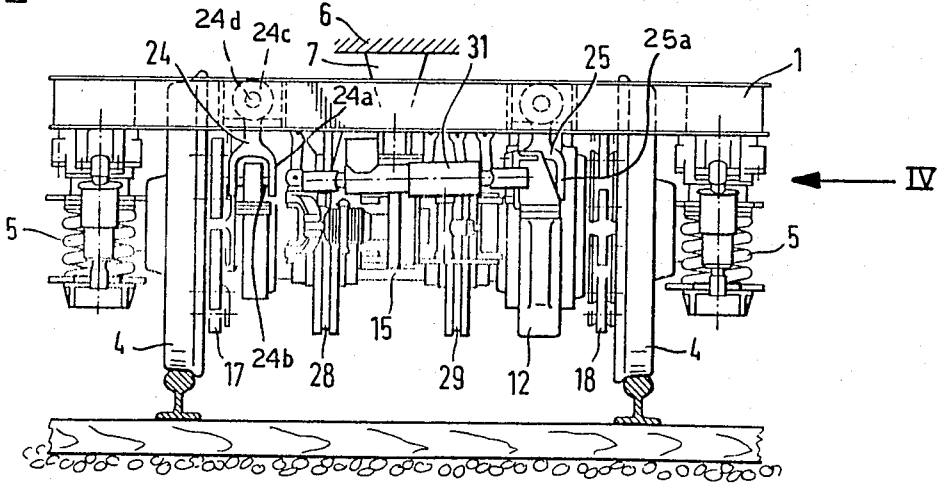
FIG. 3 is a view taken in the direction of arrow III of FIG. 2.

(FIGS. 2 and 3) to the gear transmissions 12, 13 and the support brackets 19, 20, respectively, the pivot pins 24*b* extending transverse to the direction of travel. Such construction enables a pivoting movement of the gear transmissions 12, 13 and the support brackets 19, 20 in the direction of travel. That movement is damped by shock absorbers 31 each being connected between the corresponding gear transmission 12 and 13, respectively and the frame 1. The opposite ends 24*c* of each of these support forks 24, 25 is connected to the frame 1 by a pivot pin 24*d* extending in the direction of travel.

The drive units 10/12/19 or 11/13/20 also bear against a thrust plate 26 fixed to the lower end of the pin 7 so that the weight of these elements and of the ring 23 are taken up by the chassis 6 via the pin.

While the springs 5 form the primary suspension members, a secondary elastic suspension may be formed by springs 27 which can bear on the underside of the chassis and support the latter against the frame 1 in such a manner as to enable the angular displacement about the pivot 7.

The second hollow shaft 15 or 16 moves together with the drive unit 10/12/19 or 11/13/20 and each carries brake disks 28 or 29 which cooperate with yokes and brakeshoes forming disk brake units which have generally been represented at 30.

The disk brake units 30 can be mounted directly upon the transmission housing 12 or 13 and the support brackets 19 or 20.

This has the advantage that the secondary suspension which is in part effective with the drive unit, also is effective for suspension of the disk brake system 28, 29, 30.

The assembly 30 (FIG. 2) is carriedon a beam 30*a* which bridges between the bracket 19 or 20 and the housing 12*a* or 13*a* of the respective transmission. The hydraulic or pneumatic brake actuator is represented at 30*b* and engages a lever 30*c* which is fulcrumed at 30*d* and displaces the brakeshoe 30*e* against the disk 28 or 29 when the disk brake is actuated.

We claim:

1. A railroad truck assembly comprising:

a vehicle chassis;

a pivot pin extending downwardly from said chassis;

a support frame below said chassis angularly displaceable about and connected to said pivot pin;

at least two wheel sets, each including a pair of wheels and a wheel axle mounted in said frame;

a primary spring suspension between said axle and said frame;

a secondary spring suspension between said frame and said chassis;

at least two drive trains each including a motor and gearing applying drive forces to one wheel of a corresponding wheel set;

respective first pivot means for each drive train articulated to one end of the respective drive train and rotatably supported on said support frame whereby a first portion of the weight of each drive train is transferred to said support frame thus being resiliently suspended by said primary spring suspension; and respective second pivot means for each drive train articulated to the other end of the respective drive train and rotatably supported on said pin together with the second pivot means of the other drive train whereby a second portion of the weight of each drive train is transferred to said chassis through said pin thus being resiliently suspended by said secondary spring suspension, each of said pivot means defining a pair of mutually perpendicular pivot axes.

2. The assembly defined in claim 1 wherein said second pivot means is secured to said drive train in the region of said motor.

3. The assembly defined in claim 1 wherein said second pivot means is secured so as to be axially immovable on said pin.

4. The assembly defined in claim 3 wherein said pivot pin is provided with a thrust plate supporting said second pivot means on said pin so that it is axially immovable thereon.

5. The assembly defined in claim 1 wherein said drive train includes a gear housing flanged to said motor at one end thereof and a support bracket connected to said motor at the opposite end thereof and extending parallel to said housing.

6. The assembly defined in claim 5, further comprising a brake unit mounted between an end of said bracket and an end of said housing remote from said motor.

7. The assembly defined in claim 5 wherein said first pivot means comprises at least two support forks, the one support fork is pivotally connected the one end of said gear housing to said frame and the other support fork is pivotally connecting the one end of said support bracket to said frame.

* * * * *